US009200218B2

(12) United States Patent
Dougherty et al.

(10) Patent No.: US 9,200,218 B2
(45) Date of Patent: Dec. 1, 2015

(54) FUELS HYDROCRACKING WITH DEWAXING OF FUEL PRODUCTS

(75) Inventors: Richard Dougherty, Moorestown, NJ (US); William J. Novak, Bedminster, NJ (US); Stuart S. Shih, Gainesville, VA (US); Stephen J. McCarthy, Center Valley, PA (US); Michel Daage, Hellertown, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 242 days.

(21) Appl. No.: 13/432,098

(22) Filed: Mar. 28, 2012

(65) Prior Publication Data

US 2012/0248008 A1 Oct. 4, 2012

Related U.S. Application Data

(60) Provisional application No. 61/470,077, filed on Mar. 31, 2011.

(51) Int. Cl.
*C10G 65/12* (2006.01)
*C10G 45/64* (2006.01)
(Continued)

(52) U.S. Cl.
CPC ..... *C10G 65/12* (2013.01); *C10G 45/64* (2013.01); *C10G 65/10* (2013.01); *C10G 69/10* (2013.01); *C10G 2300/1055* (2013.01); *C10G 2300/1059* (2013.01); *C10G 2300/1074* (2013.01); *C10G 2300/301* (2013.01); *C10G 2300/304* (2013.01);
(Continued)

(58) Field of Classification Search
CPC ..... C10G 65/12; C10G 69/08; C10G 69/10; C10G 35/04; C10G 35/095
USPC ..... 208/58, 60, 95, 100, 102, 134, 141
See application file for complete search history.

(56) References Cited

U.S. PATENT DOCUMENTS 3,256,177 A 6/1966 Tulleners et al.
3,816,296 A 6/1974 Hass et al.
(Continued)

FOREIGN PATENT DOCUMENTS

CN 1769390 A 5/2006
JP 2007246663 A 9/2007
(Continued)

OTHER PUBLICATIONS

A. Duker, "Use new catalyst technologies to process ultra-low-sulfur diesel," Hydrocarbon Processing, Feb. 2008, pp. 59-60, 62, vol. 87.
(Continued)

*Primary Examiner* — Renee E Robinson
(74) *Attorney, Agent, or Firm* — Bruce M. Bordelon; Chad A. Guice

(57) ABSTRACT

This invention relates to a process involving hydrocracking and dewaxing of a feedstream in which a converted fraction can correspond to a majority of the product from the reaction system, while an unconverted fraction can exhibit improved properties. In this hydrocracking process, it can be advantageous for the yield of unconverted fraction for gasoline fuel application to be controlled to maintain desirable cold flow properties for the unconverted fraction. Catalysts and conditions can be chosen to assist in attaining, or to optimize, desirable product yields and/or properties.

11 Claims, 3 Drawing Sheets

(51) Int. Cl.
*C10G 65/10* (2006.01)
*C10G 69/10* (2006.01)

(52) U.S. Cl.
CPC .... *C10G 2300/305* (2013.01); *C10G 2300/307* (2013.01); *C10G 2400/02* (2013.01); *C10G 2400/04* (2013.01)

(56) References Cited

U.S. PATENT DOCUMENTS

| | | | | |
|---|---|---|---|---|
| 4,426,276 | A | 1/1984 | Dean et al. | |
| 4,743,354 | A | 5/1988 | Ward | |
| 4,851,109 | A * | 7/1989 | Chen et al. | 208/58 |
| 4,983,273 | A | 1/1991 | Kennedy et al. | |
| 4,985,134 | A * | 1/1991 | Derr et al. | 208/84 |
| 5,128,024 | A | 7/1992 | LaPierre et al. | |
| 5,385,663 | A | 1/1995 | Zimmerman et al. | |
| 5,603,824 | A | 2/1997 | Kyan et al. | |
| 5,611,912 | A | 3/1997 | Han et al. | |
| 5,730,858 | A | 3/1998 | Olivier et al. | |
| 5,935,414 | A | 8/1999 | Sonnemans et al. | |
| 6,054,040 | A | 4/2000 | Balai et al. | |
| 6,517,704 | B1 | 2/2003 | Carroll et al. | |
| 7,261,805 | B2 | 8/2007 | Grove et al. | |
| 2001/0001449 | A1 | 5/2001 | Kiliany et al. | |
| 2004/0108250 | A1 * | 6/2004 | Murphy et al. | 208/89 |
| 2009/0045100 | A1 | 2/2009 | Yoon et al. | |
| 2009/0159489 | A1 | 6/2009 | Lopez et al. | |
| 2010/0116712 | A1 * | 5/2010 | Dziabala et al. | 208/57 |
| 2010/0187155 | A1 | 7/2010 | McCarthy et al. | |

FOREIGN PATENT DOCUMENTS

| | | | |
|---|---|---|---|
| WO | 9723584 | A1 | 7/1997 |
| WO | 2010053468 | | 5/2010 |
| WO | 2010077352 | | 7/2010 |

OTHER PUBLICATIONS

Marvin F. L. Johnson, "Estimation of the Zeolite Content of a Catalyst from Nitrogen Adsorption Isotherms," Journal of Catalysts, 1978, pp. 425-431, vol. 52.

"Hydroprocessing: ULSD: Question 16," NPRA Question and Answer Session on Refining and Petrochemical Technology, Oct. 2008, p. 14, Champions Gate, Florida.

N.G. Laz'yan, et al., "Study of chemical reactions during hydrocracking-hydroisomerization of medium petroleum distillates," Prevrashch. Uglevodorodov Kislotno-Osnovn. Geterogennykh Katal., Tezisy Dokl., Vses. Konf. (1977), Moscow, USSR.

* cited by examiner

FUELS HYDROCRACKING WITH DEWAXING OF FUEL PRODUCTS

CROSS-REFERENCE TO RELATED APPLICATION

This application claims priority to U.S. Provisional Application Ser. No. 61/470,077 filed Mar. 31, 2011, which is herein incorporated by reference in its entirety.

FIELD

The disclosures herein relate to hydrocarbon feedstocks and products, and hydrotreating processes thereof.

BACKGROUND

One method for increasing the feedstocks suitable for production of fuels can be to use cracking to convert higher boiling petroleum feeds to lower boiling products. For example, distillate boiling range feeds can be hydrocracked to generate additional naphtha boiling range products.

U.S. Pat. No. 5,385,663 describes an integrated process for hydrocracking and catalytic dewaxing of middle distillates. An initial feed is hydrocracked to produce at least a middle distillate stream having a boiling range from 232° C.-450° C. This middle distillate stream is then dewaxed. Some naphtha boiling range compounds are also produced, but an amount of conversion to lower boiling products is not specified.

U.S. Pat. No. 5,603,824 describes a process for upgrading hydrocarbons to produce a distillate product and a high octane naphtha product. An initial feed suitable for distillate production is split into a lower boiling fraction and a higher boiling fraction at a cut point between about 500° C. and 800° C. The higher boiling fraction is hydrocracked. The fractions are combined after hydrocracking for dewaxing. Because the lower boiling portion is not hydrocracked, the method has a substantial distillate yield.

U.S. Pat. No. 5,730,858 describes a process for converting hydrocarbon feedstocks into middle distillate products. A feedstock is first treated with an aqueous acid solution. The feedstock is then subjected to hydrocracking and dewaxing. The target product appears to be a distillate product with a boiling range between 149° C. and 300° C.

U.S. Patent Application Publication 2009/0159489 describes a process for making high energy distillate fuels. A highly aromatic feedstream is contacted with a hydrotreating catalyst, hydrocracking catalyst, and dewaxing catalyst in a single stage reactor. At least a portion of the highly aromatic stream is converted to a jet fuel or diesel product.

SUMMARY OF EMBODIMENTS OF THE INVENTION

In one embodiment of the invention herein is a method for producing a naphtha product and an unconverted product, comprising:

exposing a feedstock to a first hydrocracking catalyst under first effective hydroprocessing conditions to form a first hydrocracked effluent, the feedstock having a cetane number of about 35 or less, at least about 60 wt % of the feedstock boiling above about 400° F. (about 204° C.) and at least about 60 wt % of the feedstock boiling below about 650° F. (about 343° C.);

exposing the first hydrocracked effluent, without intermediate separation, to a first dewaxing catalyst under first effective dewaxing conditions to form a dewaxed effluent;

separating the dewaxed effluent to form a first gas phase portion and a first liquid phase portion;

fractionating the first liquid phase portion and a second liquid phase portion in a first fractionator to form at least one naphtha fraction and an unconverted fraction, the naphtha fraction corresponding to at least about 65 wt % of the feedstock and having a final boiling point of about 400° F. (about 204° C.) or less;

withdrawing at least a first portion of the uncoverted fraction as an unconverted product stream, the weight of the unconverted product stream corresponding to from about 5 wt % to about 35 wt % of the feedstock; wherein the unconverted product stream has an initial boiling point of at least about 400° F. (about 204° C.), a cetane number of at least about 45, and a cloud point at least about 10° F. (about 6° C.) less than the cloud point of the feedstock;

exposing at least a second portion of the unconverted fraction to a second hydrocracking catalyst under second effective hydroprocessing conditions to form a second hydrocracked effluent;

separating the second hydrocracked effluent to form a second gas phase portion and the second liquid phase portion; and sending at least a portion of the second liquid phase portion to the first fractionator.

In another embodiment of the invention herein is a method for producing an improved octane naphtha product stream, comprising:

exposing a light cycle oil from a fluid catalytic cracking process to a first hydrocracking catalyst under first effective hydroprocessing conditions to form a first hydrocracked effluent, the light cycle oil having a cetane number of about 35 or less, at least about 60 wt % of the feedstock boiling above about 400° F. (about 204° C.) and at least about 60 wt % of the feedstock boiling below about 650° F. (about 343° C.);

exposing the first hydrocracked effluent, without intermediate separation, to a first dewaxing catalyst under first effective dewaxing conditions to form a dewaxed effluent;

separating the dewaxed effluent to form a first gas phase portion and a first liquid phase portion;

fractionating the first liquid phase portion and a second liquid phase portion in a first fractionator to form at least one naphtha fraction and an unconverted fraction, the naphtha fraction corresponding to at least about 65 wt % of the feedstock and having a final boiling point of about 400° F. (about 204° C.) or less;

withdrawing at least a portion of the unconverted fraction as an unconverted product stream, the weight of the unconverted product stream corresponding to from about 5 wt % to about 35 wt % of the light cycle oil; wherein the unconverted product stream has an initial boiling point of at least about 400° F. (about 204° C.), a cetane number of at least about 45, and a cloud point at least about 10° F. (about 6° C.) less than the cloud point of the light cycle oil;

exposing at least a second portion of the unconverted fraction to a second hydrocracking catalyst under second effective hydroprocessing conditions to form a second hydrocracked effluent;

separating the second hydrocracked effluent to form a second gas phase portion and the second liquid phase portion;

sending at least a portion of the second liquid phase portion to the first fractionator; and sending the at least one naphtha fraction to a reformer unit and producing an improved naphtha product stream, wherein the improved naphtha product stream has a to higher octane value (RON+MON) than the naphtha fraction.

DETAILED DESCRIPTION OF THE EMBODIMENTS

Overview

Figure 1:
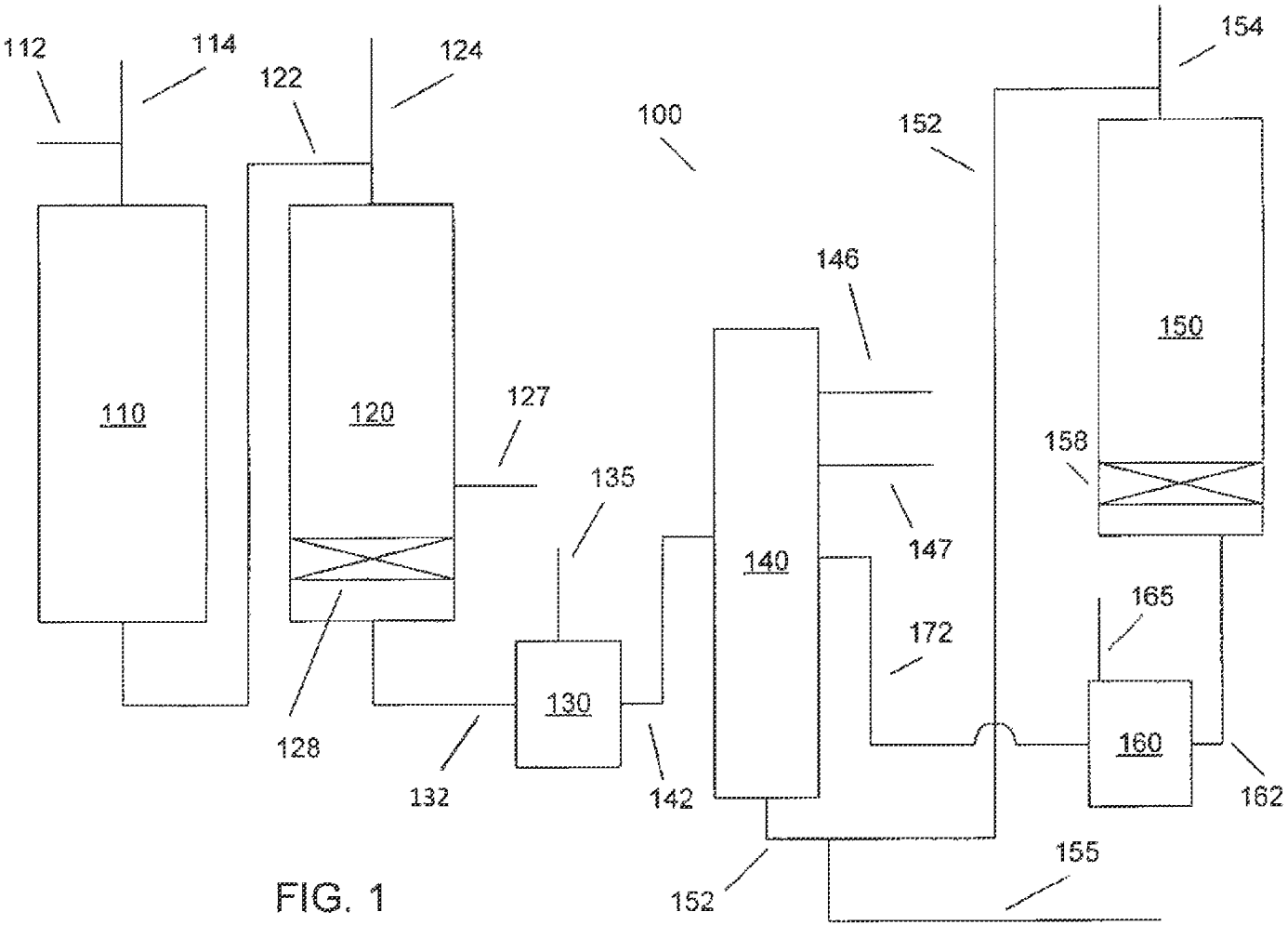
FIG. 1 schematically shows a first embodiment of a reaction system suitable for processing of a hydrocarbon feed according to the invention.

In various embodiments, methods are provided that can allow for production of a naphtha product and an unconverted product, the unconverted product having an increased cetane value, improved cold flow properties, and/or a greater yield of unconverted product at a given target for cetane value and/or cold flow properties. The methods can include hydrocracking of a distillate feed in a two stage reaction system. The effluent from the first stage can be fractionated to produce a converted fraction and an unconverted fraction. The converted fraction can be suitable for use, for example as a naphtha product, or can be subjected to further processing, such as reforming. A portion of the unconverted fraction can be withdrawn as an unconverted product, such as a diesel product, while a remaining portion of the unconverted fraction can be hydrocracked in a second stage. The effluent from the second stage can be returned to the fractionator to form a recycle loop. A dewaxing catalyst can be included in the first and/or the second stage to allow for dewaxing of hydrocracked effluent in the corresponding stage. This can allow for a desired level of production of the converted fraction while producing a second unconverted product with desirable properties.

One conventional process for gasoline production can be to convert a higher boiling feed into a naphtha boiling range product. For example, a relatively low-grade distillate feed, such as a light cycle oil, can be hydrocracked to gasoline at high conversion with some internal recycle of unconverted product. Instead of recycling the entire unconverted product, a portion of the unconverted product can be withdrawn as an unconverted product, such as a diesel product. This withdrawn unconverted product can have improved properties relative to the feed. For example, the cetane of the unconverted product can be increased relative to the feed, e.g., allowing the cetane for the unconverted product to likely meet an on-road diesel specification. The sulfur content of the unconverted product can additionally or alternately be improved and can advantageously have a sulfur content suitable for use as ultra low sulfur diesel.

By operating a light feed hydrocracker reaction system to have less than 100% conversion of feed to naphtha boiling range products, the reaction system can be used to make a portion of this improved unconverted product. Operating the light feed hydrocracker reaction system to produce an unconverted product in addition to a converted product can provide flexibility for refineries to match products with changes in demand. However, as the amount of conversion is reduced to increase the amount of yield for the unconverted product, it has been found that the cloud point of the unconverted product can increase, resulting in a cloud point that can exceed the specification shown in ASTM D975 for a diesel fuel. Another factor that can impact the cloud point of a diesel product can be the input feedstock for the process. If a refinery desires to generally increase distillate production, an additional volume of higher boiling feeds may be processed, such as additional quantities of heavy atmospheric gas oils. The initial cold flow properties of these heavier feeds can be less favorable.

In various embodiments, methods are provided for producing a converted product and an unconverted product. The converted product and unconverted product can be defined relative to a conversion temperature. An at least partially distillate boiling range feed can be exposed to hydrocracking conditions in a first hydrocracking stage. A dewaxing catalyst can be included at the end of the first hydrocracking stage. The effluent from the first stage can then be passed through a separator to separate a gas phase portion of the effluent from a liquid phase portion. The liquid effluent can then be fractionated to produce at least a converted fraction and an unconverted fraction. A portion of the unconverted fraction can be withdrawn as an unconverted product. Because of the presence of the dewaxing catalyst at the end of the first stage, the unconverted product can have improved cold flow properties. The remaining portion of the unconverted fraction can then be exposed to hydrocracking conditions in a second hydrocracking stage. The effluent from the second hydrocracking stage can be separated to remove a gas phase portion. The remaining liquid effluent from the second hydrocracking stage can be fed to a (the same) fractionator. Optionally, the liquid effluent from the first stage and the second stage can be combined prior to entering the fractionator. Optionally, the dewaxing catalyst can be included at the end of the second stage instead of the first stage, or dewaxing catalyst can optionally be included at the end of both the first stage and the second stage.

In some embodiments, incorporating dewaxing catalyst into a hydrocracking stage in a light feed hydrocracker can provide one or more advantages. Including a dewaxing catalyst can increase the amount of unconverted product that can be withdrawn from a light feed hydrocracker while still maintaining desired levels for the cetane number and/or the cloud point for the unconverted product. By incorporating the dewaxing catalyst into a hydrocracking stage, the entire hydrocracking effluent can be exposed to the dewaxing catalyst. In some embodiments, this can allow lower temperatures to be used during dewaxing while still achieving a desired improvement in cold flow properties. In an embodiment where dewaxing catalyst is included in the first hydrocracking stage, the hydrocracked effluent can be exposed to the dewaxing catalyst under sour conditions. This can reduce the amount of incidental aromatic saturation performed by the dewaxing catalyst. This can reduce the amount of hydrogen consumed during dewaxing.

Feedstock

A mineral hydrocarbon feedstock refers to a hydrocarbon feedstock derived from crude oil that has optionally been subjected to one or more separation and/or other refining processes. The mineral hydrocarbon feedstock can be a petroleum feedstock boiling in the diesel range or above. Examples of suitable feeds can include atmospheric gas oils, light cycle oils, or other feeds with a boiling range profile similar to an atmospheric gas oil and/or a light cycle oil. Other examples of suitable feedstocks can include, but are not limited to, virgin distillates, hydrotreated virgin distillates, kerosene, diesel boiling range feeds (such as hydrotreated diesel boiling range feeds), and the like, and combinations thereof.

The boiling range of a suitable feedstock can be characterized in various manners. One option can be to characterize the amount of feedstock that boils above about 350° F. (about 177° C.). At least about 60 wt %, or at least about 80 wt %, or at least about 90 wt % of a feedstock can boil above about 350° F. (about 177° C.). Additionally or alternately, at least about 60 wt %, for example at least about 80 wt % or at least about 90 wt %, of the feedstock can boil above about 400° F. (about 204° C.). Another option can be to characterize the amount of feed that boils below a temperature value. In addition to or as an alternative to the boiling range features described above, at least about 60 wt %, for example at least about 80 wt % or at least about 90 wt %, of a feedstock can boil below about 650° F. (about 343° C.). Additionally or alternately, at least about 60 wt %, for example at least about 80 wt % or at least about 90 wt %, of a feedstock can boil below about 700° F. (about 371° C.). Further additionally or alternatively, a feedstock can have a final boiling point of about 700° F. (about 371° C.) or less, for example of about 750° F. (about 399° C.) or less, of about 800° F. (about 427° C.) or less, or of about 825° F. (about 441° C.) or less.

In some embodiments, a "sour" feed can be used. In such embodiments, the nitrogen content can be at least about 50 wppm, for example at least about 75 wppm or at least about 100 wppm. Even in such "sour" embodiments, the nitrogen content can optionally but preferably be about 2000 wppm or less, for example about 1500 wppm or less or about 1000 wppm or less. Additionally or alternately in such "sour" embodiments, the sulfur content can be at least about 100 wppm, for example at least about 200 wppm or at least about 500 wppm. Further additionally or alternately, even in such "sour" embodiments, the sulfur content can optionally but preferably be about 3.0 wt % or less, for example about 2.0 wt % or less or about 1.0 wt % or less.

In some embodiments a "sweet" feed having a relatively lower level of sulfur and/or nitrogen contaminants may be used as at least a portion of the feed entering a reactor. A sweet feed can represent a hydrocarbon feedstock that has been hydrotreated and/or that otherwise can have a relatively low sulfur and nitrogen content. For example, the input flow to the second stage of the hydrocracking reaction system can typically be a sweet feed. In such embodiments, the sulfur content can advantageously be about 100 wppm or less, for example about 50 wppm or less, about 20 wppm or less, or about 10 wppm or less. Additionally or alternately in such embodiments, the nitrogen content can be about 50 wppm or less, for example about 20 wppm or less or about 10 wppm or less.

In the discussion below, a biocomponent feedstock refers to a hydrocarbon feedstock derived from a biological raw material component, from biocomponent sources such as vegetable, animal, fish, and/or algae. Note that, for the purposes of this document, vegetable fats/oils refer generally to any plant based material, and can include fat/oils derived from a source such as plants of the genus *Jatropha*. Generally, the biocomponent sources can include vegetable fats/oils, animal fats/oils, fish oils, pyrolysis oils, and algae lipids/oils, as well as components of such materials, and in some embodiments can specifically include one or more type of lipid compounds. Lipid compounds are typically biological compounds that are insoluble in water, but soluble in nonpolar (or fat) solvents. Non-limiting examples of such solvents include alcohols, ethers, chloroform, alkyl acetates, benzene, and combinations thereof.

Major classes of lipids include, but are not necessarily limited to, fatty acids, glycerol-derived lipids (including fats, oils and phospholipids), sphingosine-derived lipids (including ceramides, cerebrosides, gangliosides, and sphingomyelins), steroids and their derivatives, terpenes and their derivatives, fat-soluble vitamins, certain aromatic compounds, and long-chain alcohols and waxes.

In living organisms, lipids generally serve as the basis for cell membranes and as a form of fuel storage. Lipids can also be found conjugated with proteins or carbohydrates, such as in the form of lipoproteins and lipopolysaccharides.

Examples of vegetable oils that can be used in accordance with this invention include, but are not limited to rapeseed (canola) oil, soybean oil, coconut oil, sunflower oil, palm oil, palm kernel oil, peanut oil, linseed oil, tall oil, corn oil, castor oil, jatropha oil, jojoba oil, olive oil, flaxseed oil, camelina oil, safflower oil, babassu oil, tallow oil, and rice bran oil.

Vegetable oils as referred to herein can also include processed vegetable oil material. Non-limiting examples of processed vegetable oil material include fatty acids and fatty acid alkyl esters. Alkyl esters typically include $C_1$-$C_5$ alkyl esters. One or more of methyl, ethyl, and propyl esters are preferred.

Examples of animal fats that can be used in accordance with the invention include, but are not limited to, beef fat (tallow), hog fat (lard), turkey fat, fish fat/oil, and chicken fat. The animal fats can be obtained from any suitable source including restaurants and meat production facilities.

Animal fats as referred to herein also include processed animal fat material. Non-limiting examples of processed animal fat material include fatty acids and fatty acid alkyl esters. Alkyl esters typically include $C_1$-$C_5$ alkyl esters. One or more of methyl, ethyl, and propyl esters are preferred.

Algae oils or lipids are typically contained in algae in the form of membrane components, storage products, and metabolites. Certain algal strains, particularly microalgae such as diatoms and cyanobacteria, contain proportionally high levels of lipids. Algal sources for the algae oils can contain varying amounts, e.g., from 2 wt % to 40 wt % of lipids, based on total weight of the biomass itself.

Algal sources for algae oils include, but are not limited to, unicellular and multicellular algae. Examples of such algae include a rhodophyte, chlorophyte, heterokontophyte, tribophyte, glaucophyte, chlorarachniophyte, euglenoid, haptophyte, cryptomonad, dinoflagellum, phytoplankton, and the like, and combinations thereof. In one embodiment, algae can be of the classes Chlorophyceae and/or Haptophyta. Specific species can include, but are not limited to, *Neochloris oleoabundans, Scenedesmus dimorphus, Euglena gracilis, Phaeodactylum tricornutum, Pleurochrysis carterae, Prymnesium parvum, Tetraselmis chui*, and *Chlamydomonas reinhardtii.*

The biocomponent feeds usable in the present invention can include any of those which comprise primarily triglycerides and free fatty acids (FFAs). The triglycerides and FFAs typically contain aliphatic hydrocarbon chains in their structure having from 8 to 36 carbons, for example from 10 to 26 carbons or from 14 to 22 carbons. Types of triglycerides can be determined according to their fatty acid constituents. The fatty acid constituents can be readily determined using Gas Chromatography (GC) analysis. This analysis involves extracting the fat or oil, saponifying (hydrolyzing) the fat or oil, preparing an alkyl (e.g., methyl) ester of the saponified fat or oil, and determining the type of (methyl) ester using GC analysis. In one embodiment, a majority (i.e., greater than 50%) of the triglyceride present in the lipid material can be comprised of $C_{10}$ to $C_{26}$, for example $C_{12}$ to $C_{18}$, fatty acid constituents, based on total triglyceride present in the lipid material. Further, a triglyceride is a molecule having a structure substantially identical to the reaction product of glycerol and three fatty acids. Thus, although a triglyceride is described herein as being comprised of fatty acids, it should be understood that the fatty acid component does not necessarily contain a carboxylic acid hydrogen. Other types of feed that are derived from biological raw material components can include fatty acid esters, such as fatty acid alkyl esters (e.g., FAME and/or FAEE).

Biocomponent based diesel boiling range feedstreams typically have relatively low nitrogen and sulfur contents. For example, a biocomponent based feedstream can contain up to about 500 wppm nitrogen, for example up to about 300 wppm nitrogen or up to about 100 wppm nitrogen. Instead of nitrogen and/or sulfur, the primary heteroatom component in biocomponent feeds is oxygen. Biocomponent diesel boiling range feedstreams, e.g., can include up to about 10 wt % oxygen, up to about 12 wt % oxygen, or up to about 14 wt % oxygen. Suitable biocomponent diesel boiling range feedstreams, prior to hydrotreatment, can include at least about 5 wt % oxygen, for example at least about 8 wt % oxygen.

In an embodiment, the feedstock can include up to about 100% of a feed having a biocomponent origin. This can be a hydrotreated vegetable oil feed, a hydrotreated fatty acid alkyl ester feed, or another type of hydrotreated biocomponent feed. A hydrotreated biocomponent feed can be a biocomponent feed that has been previously hydroprocessed to reduce the oxygen content of the feed to about 500 wppm or less, for example to about 200 wppm or less or to about 100 wppm or less. Correspondingly, a biocomponent feed can be hydrotreated to reduce the oxygen content of the feed, prior to other optional hydroprocessing, to about 500 wppm or less, for example to about 200 wppm or less or to about 100 wppm or less. Additionally or alternately, a biocomponent feed can be blended with a mineral feed, so that the blended feed can be tailored to have an oxygen content of about 500 wppm or less, for example about 200 wppm or less or about 100 wppm or less. In embodiments where at least a portion of the feed is of a biocomponent origin, that portion can be at least about 2 wt %, for example at least about 5 wt %, at least about 10 wt %, at least about 20 wt %, at least about 25 wt %, at least about 35 wt %, at least about 50 wt %, at least about 60 wt %, or at least about 75 wt %. Additionally or alternately, the biocomponent portion can be about 75 wt % or less, for example about 60 wt % or less, about 50 wt % or less, about 35 wt % or less, about 25 wt % or less, about 20 wt % or less, about 10 wt % or less, or about 5 wt % or less.

In embodiments where the feed is a mixture of a mineral feed and a biocomponent feed, the mixed feed can have a sulfur content of about 5000 wppm or less, for example about 2500 wppm or less, about 1000 wppm or less, about 500 wppm or less, about 200 wppm or less, about 100 wppm or less, about 50 wppm or less, about 30 wppm or less, about 20 wppm or less, about 15 wppm or less, or about 10 wppm or less. Optionally, the mixed feed can have a sulfur content of at least about 100 wppm of sulfur, or at least about 200 wppm, or at least about 500 wppm. Additionally or alternately in embodiments where the feed is a mixture of a mineral feed and a biocomponent feed, the mixed feed can have a nitrogen content of about 2000 wppm or less, for example about 1500 wppm or less, about 1000 wppm or less, about 500 wppm or less, about 200 wppm or less, about 100 wppm or less, about 50 wppm or less, about 30 wppm or less, about 20 wppm or less, about 15 wppm or less, or about 10 wppm or less.

In some embodiments, a dewaxing catalyst can be used that includes the sulfide form of a metal, such as a dewaxing catalyst that includes nickel and tungsten. In such embodiments, it can be beneficial for the feed to have at least a minimum sulfur content. The minimum sulfur content can be sufficient to maintain the sulfided metals of the dewaxing catalyst in a sulfided state. For example, the partially processed feedstock encountered by the dewaxing catalyst can have a sulfur content of at least about 100 wppm, for example at least about 150 wppm or at least about 200 wppm. Additionally or alternately, the feedstock can have a sulfur content of about 500 wppm or less, for example about 400 wppm or less or about 300 wppm or less. In yet another embodiment, the additional sulfur to maintain the metals of a dewaxing catalyst in a sulfide state can be provided by gas phase sulfur, such as $H_2S$. One potential source of $H_2S$ gas can be from hydrotreatment of the mineral portion of a feed. If a mineral feed portion is hydrotreated prior to combination with a biocomponent feed, a portion of the gas phase effluent from the hydrotreatment process or stage can be cascaded along with hydrotreated liquid effluent.

The content of sulfur, nitrogen, oxygen, and olefins (inter alga) in a feedstock created by blending two or more feedstocks can typically be determined using a weighted average based on the blended feeds. For example, a mineral feed and a biocomponent feed can be blended in a ratio of about 80 wt % mineral feed and about 20 wt % biocomponent feed. In such a scenario, if the mineral feed has a sulfur content of about 1000 wppm, and the biocomponent feed has a sulfur content of about 10 wppm, the resulting blended feed could be expected to have a sulfur content of about 802 wppm.

In an embodiment, a distillate boiling range feedstream suitable for use as a hydrocracker feed can have a cloud point of at least about 6° F. (about −14° C.), for example at least about 12° F. (about −11° C.) or at least about 18° F. (about −7° C.). Additionally or alternately, the distillate boiling range feedstream can have a cloud point of about 42° F. (about 6° C.) or less, preferably about 30° F. (about −1° C.) or less, for example about 24° F. (about −4° C.) or less, or about 15° F. (about −9° C.) or less. In an embodiment, the cetane number for the feed can be about 35 or less, or about 30 or less. Additionally or alternately, the cetane number for the feed can be a cetane number typically observed for a feed such as a light cycle oil.

Reactor Configuration

In various embodiments, a reactor configuration can be used that is suitable for performing light feed hydrocracking for generation of fuel products. The reaction system can be operated so that at least a majority of the products from the light feed hydrocracking are converted products, such as naphtha boiling range products.

A reaction system suitable for performing the inventive method can include at least two hydrocracking stages. Note that a reaction stage can include one or more beds and/or one or more reactors. The first hydrocracking stage can optionally include two or more reactors, with the total effluent passed into each reactor in a stage. In an embodiment with two or more reactors in the first stage, a first reactor can include one or more catalyst beds that contain hydrotreating catalyst. This can allow for hydrodesulfurization, hydrodenitrogenation, and/or hydrodeoxygenation of a feedstock. A second reactor can contain one or more catalyst beds of hydrocracking catalyst. Having two or more reactors can allow for additional flexibility in selecting reaction conditions between the reactors. Various alternative configurations can be used for the first stage. For example, the first stage can include beds of both hydrotreating and hydrocracking catalyst in a single reactor. Another option can be to have multiple reactors, with at least one reactor that contains both hydrotreating and hydrocracking catalyst.

In addition to the hydrocracking and optional hydrotreating catalyst, at least one bed of catalyst in the first stage can include a catalyst capable of dewaxing. Optionally but preferably, the dewaxing catalyst can be placed in a bed downstream from at least a portion of the hydrocracking catalyst in the stage, such as by placing the dewaxing catalyst in a final catalyst bed in the stage. Other options for the location of dewaxing catalyst can be: to place the dewaxing catalyst after all of the hydrocracking catalyst; to place the dewaxing catalyst after at least one bed of hydrocracking catalyst; or to place the dewaxing catalyst before the first bed of the hydrocracking catalyst. Placing the dewaxing catalyst in the final bed of the stage can allow the dewaxing to occur on the products of the hydrocracking reaction. This means that dewaxing can be performed on any paraffinic species created due to ring-opening during the hydrocracking reactions. Additionally, having the dewaxing catalyst in a separate bed from the hydrocracking catalyst can allow for some additional control of reaction conditions during catalytic dewaxing, such as allowing for some separate temperature control of the dewaxing and hydrocracking processes. Locating the dewaxing catalyst in the first stage can allow the dewaxing to be performed on the total feedstock/effluent in the stage.

One option for achieving additional control of the dewaxing reaction conditions can be to include a quench between the hydrocracking catalyst bed(s) and the dewaxing catalyst bed(s). Because hydroprocessing reactions are typically exothermic, using a quench stream between beds of hydroprocessing catalyst can provide some temperature control to allow for selection of dewaxing conditions. For example, an optional gas quench, such as a hydrogen gas quench and/or an inert gas quench, can be included between the hydrocracking beds and the dewaxing bed. If hydrogen is introduced as part of the quench, the quench hydrogen can also modify the amount of available hydrogen for the dewaxing reactions.

A separation device can be used after the first stage to remove gas phase contaminants generated during exposure of the feedstock to the hydrocracking, dewaxing, and/or hydrotreating catalysts. The separation device can produce a gas phase output and a liquid phase output. The gas phase output can be treated in a typical manner for a contaminant gas phase output, such as scrubbing the gas phase output to allow for recycling of any hydrogen content.

The liquid phase output from the separator can then be fractionated to form at least a converted fraction and an unconverted fraction. For example, the fractionator can be used to produce at least a naphtha fraction and a diesel fraction. Additional fractions can also be produced, such as a heavy naphtha fraction. Any naphtha fractions from the fractionator can be sent to the gasoline pool, or the naphtha fractions can undergo further processing. Such further processing can be used, for example, to improve the octane rating of the gasoline. This could include using a naphtha fraction as a feed to a reforming unit.

A portion of the unconverted fraction can be withdrawn as a product stream. The remainder of the unconverted fraction can be used as an input for a second hydrocracking stage. Relative to the first stage, the second hydrocracking stage can have a relatively low level of sulfur and nitrogen contaminants. The hydrocracking conditions in the second stage can be selected to achieve a total desired level of conversion. Optionally, a dewaxing catalyst can be included in the second stage in addition to and/or in place of the dewaxing catalyst in the first stage.

Optionally, the second stage effluent can be passed into another gas-liquid separation device. The gas phase portion from the separation device can be recycled to recapture hydrogen, or used in any other convenient manner. The liquid phase portion can be fed to the fractionator. The liquid phase portion can be combined with the liquid effluent from the first stage prior to entry into the fractionator, or the two liquid effluent streams can enter the fractionator at separate locations. Alternately, separate fractionators can be used to process the first and the second stage effluents.

In an alternative embodiment, a preliminary stage can be included prior to the first stage. In this type of embodiment, a preliminary stage reactor (or reactors) can be used to perform hydrotreatment of a feedstock. The preliminary stage reactor (s) can optionally include hydrocracking catalyst as well. A gas-liquid separation device can be used after the preliminary stage reactor(s) to separate gas phase products. The liquid effluent from the preliminary stage reactor(s) can then pass into the one or more first stage reactors that include hydrocracking catalyst. As described above, the one or more first stage reactors can optionally also include some hydrotreating catalyst. An embodiment involving a preliminary stage can be useful, for example, if the feedstock includes a biocomponent portion. The preliminary stage reactor(s) can be operated to perform a mild hydrotreatment that is sufficient for hydrodeoxygenation of the (biocomponent-containing) feed, as well as some optional hydrodesulfurization and/or hydrodenitrogenation. The hydrodeoxygenation reaction can produce CO and $CO_2$ as contaminant by-products. In addition to being potential catalyst poisons, any CO generated may be difficult to handle, particularly if it is passed into the general refinery hydrogen recycle system. Using a preliminary hydrotreatment stage can allow contaminants such as CO and $CO_2$ to be removed in the preliminary stage separation device. The gas phase effluent from the preliminary stage separation device can then receive different handling from a typical gas phase effluent. For example, it may be cost effective to use the gas phase effluent from a preliminary stage separator as fuel gas, as opposed to attempting to scrub the gas phase effluent and recycle the hydrogen.

Catalyst and Reaction Conditions

In various embodiments, the reaction conditions in the reaction system can be selected to generate a desired level of conversion of a feed. Conversion of the feed can be defined in terms of conversion of molecules that boil above a temperature threshold to molecules below that threshold. For example, in a light feed hydrocracker, the conversion temperature can be about 350° F. (about 177° C.), for example about 375° F. (about 191° C.), about 400° F. (about 204° C.), or about 425° F. (about 218° C.). Optionally, the conversion temperature can be indicative of a desired cut point for a converted fraction product generated by the light feed hydrocracker reaction system. Alternately, the conversion temperature can be a convenient temperature for characterizing the products, with cut points selected at other temperatures.

The amount of conversion of a feedstock can be characterized at several locations within a reaction system. One potential characterization for the conversion of feedstock can be the amount of conversion in the first reaction stage. As described above, the conversion temperature can be any convenient temperature, such as about 350° F. (about 177° C.), for example about 375° F. (about 191° C.), about 400° F. (about 204° C.), or about 425° F. (about 218° C.). In an embodiment, the amount of conversion in the first stage can be at least about 40%, for example at least about 50%. Additionally or alternately, the amount of conversion in the first stage can be about 75% or less, for example about 65% or less or about 60% or less. Another way to characterize the amount of conversion can be to characterize the amount of conversion in the total liquid products generated by the reaction system. This can include any naphtha, diesel, and/or other product streams that exit the reaction system. This conversion amount includes conversion that occurs in any stage of the reaction system. In an embodiment, the amount of conversion for the reaction system can be at least about 50%, for example at least about 60%, at least about 70%, or at least about 80%. Additionally or alternately, the amount of conversion for the reaction system can be about 95% or less, for example about 90% or less, about 85% or less, or about 75% or less.

Hydrocracking catalysts typically contain sulfided base metals on acidic supports, such as amorphous silica-alumina, cracking zeolites such as USY, acidified alumina, or the like, or some combination thereof. Often these acidic supports are mixed/bound with other metal oxides such as alumina, titania, silica, or the like, or combinations thereof. Non-limiting examples of metals for hydrocracking catalysts to include nickel, nickel-cobalt-molybdenum, cobalt-molybdenum, nickel-tungsten, nickel-molybdenum, and/or nickel-molybdenum-tungsten. Additionally or alternately, hydrocracking catalysts with noble metals can alternately be used. Non-limiting examples of noble metal catalysts include those based on platinum and/or palladium. Support materials which may be used for both the noble and non-noble metal catalysts can comprise a refractory oxide material such as alumina, silica, alumina-silica, kieselguhr, diatomaceous earth, magnesia, zirconia, or combinations thereof, with alumina, silica, and alumina-silica being the most common (and preferred, in some embodiments).

In various embodiments, hydrocracking conditions in the first stage and/or second stage can be selected to achieve a desired level of conversion in the reaction system. A hydrocracking process in the first stage (or otherwise under sour conditions) can be carried out at temperatures from about 550° F. (about 288° C.) to about 840° F. (about 449° C.), hydrogen partial pressures from about 250 psig (about 1.8 MPag) to about 5000 psig (about 34.6 MPag), liquid hourly space velocities from 0.05 $hr^{-1}$ to 10 $hr^{-1}$, and hydrogen treat gas rates from 200 scf/bbl (about 34 $Nm^3/m^3$) to about 10000 scf/bbl (about 1700 $Nm^3/m^3$). In other embodiments, the conditions can include temperatures in the range of about 600° F. (about 343° C.) to about 815° F. (about 435° C.), hydrogen partial pressures from about 500 psig (about 3.5 MPag) to about 3000 psig (about 20.9 MPag), liquid hourly space velocities from about 0.2 $hr^{-1}$ to about 2 $hr^{-1}$, and hydrogen treat gas rates from about 1200 scf/bbl (about 200 $Nm^3/m^3$) to about 6000 scf/bbl (about 1000 $Nm^3/m^3$).

A hydrocracking process in a second stage (or otherwise under non-sour conditions) can be performed under conditions similar to those used for a first stage hydrocracking process, or the conditions can be different. In an embodiment, the conditions in a second stage can have less severe conditions than a hydrocracking process in a first (sour) stage. The temperature in the hydrocracking process can be at least about 40° F. (about 22° C.) less than the temperature for a hydrocracking process in the first stage, for example at least about 80° F. (about 44° C.) less or at least about 120° F. (about 66° C.) less. The pressure for a hydrocracking process in a second stage can be at least 100 psig (about 690 kPag) less than a hydrocracking process in the first stage, for example at least 200 psig (about 1.4 MPag) less or at least 300 psig (2.1 MPag) less. Additionally or alternately, suitable hydrocracking conditions for a second (non-sour) stage can include, but are not limited to, conditions similar to a first or sour stage. Suitable hydrocracking conditions can include temperatures from about 550° F. (about 288° C.) to about 840° F. (about 449° C.), hydrogen partial pressures from about 250 psig (about 1.8 MPag) to about 5000 psig (about 34.6 MPag), liquid hourly space velocities from 0.05 $hr^{-1}$ to 10 $hr^{-1}$, and hydrogen treat gas rates from 200 scf/bbl (about 34 $Nm^3/m^3$) to about 10000 scf/bbl (about 1700 $Nm^3/m^3$). In other embodiments, the conditions can include temperatures in the range of about 600° F. (about 343° C.) to about 815° F. (about 435° C.), hydrogen partial pressures from about 500 psig (about 3.5 MPag) to about 3000 psig (about 20.9 MPag), liquid hourly space velocities from about 0.2 $hr^{-1}$ to about 2 $hr^{-1}$, and hydrogen treat gas rates from about 1200 scf/bbl (about 200 $Nm^3/m^3$) to about 6000 scf/bbl (about 1000 $Nm^3/m^3$).

In various embodiments, a feed can also be hydrotreated in the first stage and/or in a preliminary stage prior to further processing. A suitable catalyst for hydrotreatment can comprise, consist essentially of, or be a catalyst composed of one or more Group VIII and/or Group VIB metals on a support such as a metal oxide support. Suitable metal oxide supports can include relatively low acidic oxides such as silica, alumina, silica-aluminas, titania, or a combination thereof. The supported Group VIII and/or Group VIB metal(s) can include, but are not limited to, Co, Ni, Fe, Mo, W, Pt, Pd, Rh, Ir, and combinations thereof. Individual hydrogenation metal embodiments can include, but are not limited to, Pt only, Pd only, or Ni only, while mixed hydrogenation metal embodiments can include, but are not limited to, Pt and Pd, Pt and Rh, Ni and W, Ni and Mo, Ni and Mo and W, Co and Mo, Co and Ni and Mo, Co and Ni and W, or another combination. When only one hydrogenation metal is present, the amount of that hydrogenation metal can be at least about 0.1 wt % based on the total weight of the catalyst, for example at least about 0.5 wt % or at least about 0.6 wt %. Additionally or alternately when only one hydrogenation metal is present, the amount of that hydrogenation metal can be about 5.0 wt % or less based on the total weight of the catalyst, for example about 3.5 wt % or less, about 2.5 wt % or less, about 1.5 wt % or less, about 1.0 wt % or less, about 0.9 wt % or less, about 0.75 wt % or less, or about 0.6 wt % or less. Further additionally or alternately when more than one hydrogenation metal is present, the collective amount of hydrogenation metals can be at least about 0.1 wt % based on the total weight of the catalyst, for example at least about 0.25 wt %, at least about 0.5 wt %, at least about 0.6 wt %, at least about 0.75 wt %, or at least about 1 wt %. Still further additionally or alternately when more than one hydrogenation metal is present, the collective amount of hydrogenation metals can be about 35 wt % or less based on the total weight of the catalyst, for example about 30 wt % or less, about 25 wt % or less, about 20 wt % or less, about 15 wt % or less, about 10 wt % or less, or about 5 wt % or less. In embodiments wherein the supported metal comprises a noble metal, the amount of noble metal(s) is typically less than about 2 wt %, for example less than about 1 wt %, about 0.9 wt % or less, about 0.75 wt % or less, or about 0.6 wt % or less. The amounts of metal(s) may be measured by methods specified by ASTM for individual metals, including but not limited to atomic absorption spectroscopy (AAS), inductively coupled plasma-atomic emission spectrometry (ICP-AAS), or the like.

Hydrotreating conditions can typically include temperatures from about 550° F. (about 288° C.) to about 840° F. (about 449° C.), hydrogen partial pressures from about 250 psig (about 1.8 MPag) to about 5000 psig (about 34.6 MPag), liquid hourly space velocities from 0.05 $hr^{-1}$ to 10 $hr^{-1}$, and hydrogen treat gas rates from 200 scf/bbl (about 34 $Nm^3/m^3$) to about 10000 scf/bbl (about 1700 $Nm^3/m^3$). In other embodiments, the conditions can include temperatures in the range of about 600° F. (about 343° C.) to about 815° F. (about 435° C.), hydrogen partial pressures from about 500 psig (about 3.5 MPag) to about 3000 psig (about 20.9 MPag), liquid hourly space velocities from about 0.2 $hr^{-1}$ to about 2 $hr^{-1}$, and hydrogen treat gas rates from about 1200 scf/bbl (about 200 $Nm^3/m^3$) to about 6000 scf/bbl (about 1000 $Nm^3/m^3$). The different ranges of temperatures can be used based on the type of feed and the desired hydrotreatment result. For example, the temperature range of about 550° F. (about 288° C.) to about 650° F. (about 343° C.) could be suitable for a mild hydrotreatment process for deoxygenation of a feed containing a biocomponent portion.

In still another embodiment, the same conditions can be used for hydrotreating and hydrocracking beds or stages, such as using hydrotreating conditions for both or using hydrocracking conditions for both. In yet another embodiment, the pressure for the hydrotreating and hydrocracking beds or stages can be the same.

In various embodiments, a dewaxing catalyst can also be included in the first stage, the second stage, and/or other stages in the light feed hydrocracker. Typically, the dewaxing catalyst can be located in a bed downstream from any hydrocracking catalyst present in a stage. This can allow the dewaxing to occur on molecules that have already been hydrotreated to remove a significant fraction of organic sulfur- and nitrogen-containing species. The dewaxing catalyst can be located in the same reactor as at least a portion of the hydrocracking catalyst in a stage. Alternately, the entire effluent from a reactor containing hydrocracking catalyst can be fed into a separate reactor containing the dewaxing catalyst. Exposing the dewaxing catalyst to the entire effluent from prior hydrocracking can expose the catalyst to a hydrocarbon stream that includes both a converted fraction and an unconverted fraction. In some embodiments, exposing the dewaxing catalyst to this type of hydrocarbon stream can provide unexpected benefits. For example, using the entire hydrocarbon stream instead of just the unconverted fraction can decrease the temperature required to achieve a desired drop in cloud point for the unconverted fraction of the hydrocarbon stream. This decrease in temperature can be accompanied by an increase in space velocity for the feed over the dewaxing catalyst, such as an increase in space velocity sufficient so that at least as much unconverted fraction is dewaxed as compared to a configuration where only the unconverted fraction is dewaxed.

Suitable dewaxing catalysts can include molecular sieves such as crystalline aluminosilicates (zeolites). In an embodiment, the molecular sieve can comprise, consist essentially of, or be ZSM-5, ZSM-22, ZSM-23, ZSM-35, ZSM-48, zeolite Beta, or a combination thereof, for example ZSM-23 and/or ZSM-48, or ZSM-48 and/or zeolite Beta. Optionally but preferably, molecular sieves that are selective for dewaxing by isomerization as opposed to cracking can be used, such as ZSM-48, zeolite Beta, ZSM-23, or a combination thereof. Additionally or alternately, the molecular sieve can comprise, consist essentially of or be a 10-member ring 1-D molecular sieve. Optionally but preferably, the dewaxing catalyst can include a binder for the molecular sieve, such as alumina, titania, silica, silica-alumina, zirconia, or a combination thereof, for example alumina and/or titania or silica and/or zirconia and/or titania.

One characteristic that can impact the activity of the molecular sieve is the ratio of silica to alumina ($Si/Al_2$ ratio) in the molecular sieve. In an embodiment, the molecular sieve can have a silica to alumina ratio of about 200:1 or less, for example about 150:1 or less, about 120:1 or less, about 100:1 or less, about 90:1 or less, or about 75:1 or less. Additionally or alternately, the molecular sieve can have a silica to alumina ratio of at least about 30:1, for example at least about 40:1, at least about 50:1, or at least about 65:1.

Aside from the molecular sieve(s) and optional binder, the dewaxing catalyst can also optionally but preferably include at least one metal hydrogenation component, such as a Group VIII metal. Suitable Group VIII metals can include, but are not limited to, Pt, Pd, Ni, or a combination thereof. When a metal hydrogenation component is present, the dewaxing catalyst can include at least about 0.1 wt % of the Group VIII metal, for example at least about 0.3 wt %, at least about 0.5 wt %, at least about 1.0 wt %, at least about 2.5 wt %, or at least about 5.0 wt %. Additionally or alternately, the dewaxing catalyst can include about 10 wt % or less of the Group VIII metal, for example about 5.0 wt % or less, about 2.5 wt % or less, about 1.5 wt % or less, or about 1.0 wt % or less.

In some embodiments, the dewaxing catalyst can include an additional Group VIB metal hydrogenation component, such as W and/or Mo. In such embodiments, when a Group VIB metal is present, the dewaxing catalyst can include at least about 0.5 wt % of the Group VIB metal, for example at least about 1.0 wt %, at least about 2.5 wt %, or at least about 5.0 wt %. Additionally or alternately in such embodiments, the dewaxing catalyst can include about 20 wt % or less of the Group VIB metal, for example about 15 wt % or less, about 10 wt % or less, about 5.0 wt % or less, about 2.5 wt % or less, or about 1.0 wt % or less. In one preferred embodiment, the dewaxing catalyst can include Pt and/or Pd as the hydrogenation metal component. In another preferred embodiment, the dewaxing catalyst can include as the hydrogenation metal components Ni and W, Ni and Mo, or Ni and a combination of W and Mo.

In various embodiments, the dewaxing catalyst used according to the invention can advantageously be tolerant of the presence of sulfur and/or nitrogen during processing. Suitable catalysts can include those based on zeolites ZSM-48 and/or ZSM-23 and/or zeolite Beta. It is also noted that ZSM-23 with a silica to alumina ratio between about 20:1 and about 40:1 is sometimes referred to as SSZ-32. Additional or alternate suitable catalyst bases can include 1-dimensional 10-member ring zeolites. Further additional or alternate suitable catalysts can include EU-2, EU-11, and/or ZBM-30.

A bound dewaxing catalyst can also be characterized by comparing the micropore (or zeolite) surface area of the catalyst with the total surface area of the catalyst. These surface areas can be calculated based on analysis of nitrogen porosimetry data using the BET method for surface area measurement. Previous work has shown that the amount of zeolite content versus binder content in catalyst can be determined from BET measurements (see, e.g., Johnson, M. F. L., *Jour. Catal.*, (1978) 52, 425). The micropore surface area of a catalyst refers to the amount of catalyst surface area provided due to the molecular sieve and/or the pores in the catalyst in the BET measurements. The total surface area represents the micropore surface plus the external surface area of the bound catalyst. In one embodiment, the percentage of micropore surface area relative to the total surface area of a bound catalyst can be at least about 35%, for example at least about 38%, at least about 40%, or at least about 45%. Additionally or alternately, the percentage of micropore surface area relative to total surface area can be about 65% or less, for example about 60% or less, about 55% or less, or about 50% or less.

Additionally or alternately, the dewaxing catalyst can comprise, consist essentially of, or be a catalyst that has not been dealuminated. Further additionally or alternately, the binder for the catalyst can include a mixture of binder materials containing alumina.

Catalytic dewaxing can be performed by exposing a feedstock to a dewaxing catalyst under effective (catalytic) dewaxing conditions. Effective dewaxing conditions can include can be carried out at temperatures from about 550° F. (about 288° C.) to about 840° F. (about 449° C.), hydrogen partial pressures from about 250 psig (about 1.8 MPag) to about 5000 psig (about 34.6 MPag), liquid hourly space velocities from 0.05 $hr^{-1}$ to 10 $hr^{-1}$, and hydrogen treat gas rates from 200 scf/bbl (about 34 $Nm^3/m^3$) to about 10000 scf/bbl (about 1700 $Nm^3/m^3$). In other embodiments, the conditions can include temperatures in the range of about 600° F. (about 343° C.) to about 815° F. (about 435° C.), hydrogen partial pressures from about 500 psig (about 3.5 MPag) to about 3000 psig (about 20.9 MPag), liquid hourly space velocities from about 0.2 $hr^{-1}$ to about 2 $hr^{-1}$, and hydrogen treat gas rates from about 1200 scf/bbl (about 200 $Nm^3/m^3$) to about 6000 scf/bbl (about 1000 $Nm^3/m^3$). In some embodiments, the liquid hourly space velocity (LHSV) of the hydrocracker feed exposed to the dewaxing catalyst can be characterized differently. For instance, the LHSV of the feed relative to only the dewaxing catalyst can be at least about 0.5 $hr^{-1}$, or at least about 2 $hr^{-1}$. Additionally or alternately, the LHSV of the hydrocracker feed relative to only the dewaxing catalyst can be about 20 $hr^{-1}$ or less, or about 10 $hr^{-1}$ or less.

Additionally or alternately, the conditions for dewaxing can be selected based on the conditions for a preceding reaction in the stage, such as hydrocracking conditions or hydrotreating conditions. Such conditions can be further modified using a quench between previous catalyst bed(s) and the bed for the dewaxing catalyst. Instead of operating the dewaxing process at a temperature corresponding to the exit temperature of the prior catalyst bed, a quench can be used to reduce the temperature for the hydrocarbon stream at the beginning of the dewaxing catalyst bed. One option can be to use a quench to have a temperature at the beginning of the dewaxing catalyst bed that is about the same as the outlet temperature of the prior catalyst bed. Another option can be to use a quench to have a temperature at the beginning of the dewaxing catalyst bed that is at least about 10° F. (about 6° C.) lower than the prior catalyst bed, for example at least about 20° F. (about 11° C.) lower, at least about 30° F. (about 16° C.) lower, or at least about 40° F. (about 21° C.) lower.

Reaction Products

In various embodiments, the hydrocracking conditions in a light feed hydrocracking reaction system can be sufficient to attain a conversion level of at least about 50%, for example at least about 60%, at least about 70%, at least about 80%, or at least about 85%. Additionally or alternately, the hydrocracking conditions in the reaction system can be sufficient to attain a conversion level of not more than about 85%, not more than about 80%, or not more than about 75%, or not more than about 70%. Further additionally or alternately, the hydrocracking conditions in the high-conversion/second hydrocracking stage can be sufficient to attain a conversion level from about 50% to about 85%, for example from about 55% to about 70%, from about 60% to about 85%, or from about 60% to about 75%. As used herein, the term "conversion level," with reference to a feedstream being hydrocracked, means the relative amount of change in boiling point of the individual molecules in the feedstream from above 400° F. (about 204° C.) to 400° F. (about 204° C.) or below. Conversion level can be measured by any appropriate means and, for a feedstream whose minimum boiling point is at least 400.1° F. (204.5° C.), can represent the average proportion of material that has passed through the hydrocracking process and has a boiling point less than or equal to 400.0° F. (204.4° C.), compared to the total amount of hydrocracked material.

In various embodiments, a light feed hydrocracker reaction system can be used to produce at least a converted product and an unconverted product. The converted product can correspond to a product with a boiling point below about 400° F. (about 204° C.), while the unconverted product can correspond to a product with a boiling point above about 400° F. (about 204° C.). Note that the temperature for the conversion level can differ from the temperature for defining a converted product and an unconverted product.

A converted product can be a majority of the product generated by the light feed hydrocracker reaction system. An example of a converted product can be a naphtha boiling range product. In an embodiment, a converted product can have a boiling range from about 75° F. (about 24° C.) to about 400° F. (about 204° C.). Additionally or alternately, an initial boiling point for a converted product can be at least about 75° F. (about 24° C.), for example at least about 85° F. (about 30° C.) or at least about 100° F. (about 38° C.) and/or a final boiling point can be about 425° F. (about 218° C.) or less, for example about 400° F. (about 204° C.) or less, about 375° F. (about 191° C.) or less, or about 350° F. (about 177° C.) or less. Further additionally or alternately, it may be desirable to create multiple products from an unconverted fraction. For example, a light naphtha product can have a final boiling point of about 325° F. (about 163° C.) or less, for example about 300° F. (about 149° C.) or less or about 275° F. (about 135° C.) or less. Such a light naphtha product could be complemented by a heavy naphtha product. A heavy naphtha product can have a boiling range starting at the final boiling point for a light naphtha product, and a final boiling point as described above.

Another option for characterizing a converted product, separately or in addition to an initial and/or final boiling point, can be to characterize one or more intermediate temperatures in a boiling range. For example, a temperature where about 10 wt % of the converted product will boil can be defined. This type of value can be referred to as a T10 boiling point for the converted product. In an embodiment, the T10 boiling point for the converted product can be at least about 100° F. (about 38° C.), for example at least about 115° F. (about 46° C.) or at least about 125° F. (about 52° C.). Additionally or alternately, the T90 boiling point can be about 375° F. (about 191° C.) or less, for example about 350° F. (about 177° C.) or less or about 325° F. (about 163° C.) or less. In some situations, intermediate boiling point values such as T10 or T90 values can be beneficial for characterizing a hydrocarbon fraction, as the intermediate boiling point values may be more representative of the overall characteristics of a fraction.

The amount of converted product can vary depending on the reaction conditions. In an embodiment, at least about 65 wt % of the total liquid product generated by the light feed hydrocracker reaction system can be a converted product, for example at least about 70 wt %, at least about 75 wt %, at least about 80 wt %, or at least about 85 wt %. Additionally or alternately, about 95 wt % or less of the total liquid product can be a converted product, for example about 90 wt % or less, about 85 wt % or less, or about 75 wt % or less.

An unconverted product from the light feed hydrocracker reaction system can also be characterized in various ways. In an embodiment, an unconverted product can be a product with a boiling range from about 400° F. (about 204° C.) to about 825° F. (about 441° C.). Additionally or alternately, an initial boiling point for an unconverted product can be at least about 350° F. (about 177° C.), for example at least about 375° F. (about 191° C.), at least about 400° F. (about 204° C.), at least about 425° F. (about 218° C.), or at least about 450° F. (about 232° C.). Further additionally or alternately, a final boiling point can be about 825° F. (about 441° C.) or less, for example about 800° F. (about 427° C.) or less, about 775° F. (about 413° C.) or less, or about 750° F. (about 399° C.) or less.

Another option for characterizing an unconverted product, separately or in addition to an initial and/or final boiling point, can be to characterize one or more intermediate temperatures in a boiling range. For example, a temperature where about 10 wt % of the unconverted product will boil can be defined. This type of value can be referred to as a T10 boiling point for the unconverted product. In an embodiment, the T10 boiling point for the unconverted product can be at least about 325° F. (about 163° C.), for example at least about 350° F. (about 177° C.), at least about 375° F. (about 191° C.), at least about 400° F. (about 204° C.), at least about 425° F. (about 218° C.), or at least about 450° F. (about 232° C.). Additionally or alternately, the T90 boiling point can be about 700° F. (about 371° C.) or less, for example about 675° F. (about 357° C.) or less, about 650° F. (about 343° C.) or less, or about 625° F. (about 329° C.) or less.

Still another way to characterize an unconverted product can be based on the amount of the unconverted product that boils above about 600° F. (about 316° C.). In an embodiment, the amount of unconverted product that boils above about 600° F. (about 316° C.) can be about 25 wt % or less of the unconverted product, for example about 20 wt % or less of the unconverted product, from about 10 wt % to about 25 wt % of the unconverted product, or from about 10 wt % to about 20 wt % of the unconverted product.

The amount of unconverted product can vary depending on the reaction conditions. In an embodiment, at least about 5 wt % of the total liquid product generated by the light feed hydrocracker reaction system can be an unconverted product, for example at least about 10 wt %, at least about 15 wt %, or at least about 20 wt %. Additionally or alternately, about 35 wt % or less of the total liquid product can be an unconverted product, for example about 30 wt % or less, about 25 wt % or less, about 20 wt % or less, or about 15 wt % or less.

It is noted that the initial boiling point for the unconverted product can be dependent on how the cut point is defined for the various products generated in the fractionator. For example, if a fractionator is configured to generate a converted product and an unconverted product, the initial boiling point for the unconverted product can be related to the final boiling point for the naphtha product. Similarly, a T90 boiling point for a converted product may be related in some manner to a T10 boiling point for the unconverted product from the same fractionator.

Although the boiling ranges above are described with reference to a converted product and an unconverted product, it is understood that a plurality of different cuts could be generated by the fractionator while still satisfying the above ranges. For example, a product slate from a fractionator could include a light naphtha and a heavy naphtha as converted products, and the withdrawn portion of the unconverted fraction can correspond to a diesel product. Still other combinations of products could also be generated.

In some embodiments, the unconverted product withdrawn from the reaction system can be characterized by a cetane number. In such embodiments, the cetane number for the unconverted product can be at least about 50, for example at least about 52, at least about 55, or at least about 57.

In another embodiment, the cloud point for an unconverted product withdrawn from the reaction system can be characterized. In an embodiment, a withdrawn unconverted product can have a cloud point of about 18° F. (about −7° C.) or less, for example about 12° F. (about −11° C.) or less, about 6° F. (about −14° C.) or less, or about 0° F. (about −18° C.) or less. Additionally or alternately, the cloud point of a withdrawn unconverted product can be dependent on the amount of unconverted product withdrawn relative to the amount of feed. For example, if the withdrawn amount of unconverted product corresponds to from about 5 wt % to about 15 wt % of the feed, the cloud point of the withdrawn unconverted product can be about 30° F. (about 16° C.) lower than the cloud point of the feed. Additionally or alternately, if the withdrawn amount of unconverted product corresponds to from about 10 wt % to about 25 wt % of the feed, the cloud point of the withdrawn unconverted product can be about 20° F. (about 11° C.) lower than the cloud point of the feed. Further additionally or alternately, if the withdrawn amount of unconverted product corresponds to from about 20 wt % to about 35 wt % of the feed, the cloud point of the withdrawn unconverted product can be about 10° F. (about 6° C.) lower than the cloud point of the feed.

Other Embodiments

Additionally or alternately, the present invention can include one or more of the following embodiments.

Embodiment 1

A method for producing a naphtha product and an unconverted product, comprising:

exposing a feedstock to a first hydrocracking catalyst under first effective hydroprocessing conditions to form a first hydrocracked effluent, the feedstock having a cetane number of about 35 or less, at least about 60 wt % of the feedstock boiling above about 400° F. (about 204° C.) and at least about 60 wt % of the feedstock boiling below about 650° F. (about 343° C.);

exposing the first hydrocracked effluent, without intermediate separation, to a first dewaxing catalyst under first effective dewaxing conditions to form a dewaxed effluent;

separating the dewaxed effluent to form a first gas phase portion and a first liquid phase portion;

fractionating the first liquid phase portion and a second liquid phase portion in a first fractionator to form at least one naphtha fraction and an unconverted fraction, the naphtha fraction corresponding to at least about 65 wt % of the feedstock and having a final boiling point of about 400° F. (about 204° C.) or less;

withdrawing at least a first portion of the uncoverted fraction as an unconverted product stream, the weight of the unconverted product stream corresponding to from about 5 wt % to about 35 wt % of the feedstock; wherein the unconverted product stream has an initial boiling point of at least about 400° F. (about 204° C.), a cetane number of at least about 45, and a cloud point at least about 10° F. (about 6° C.) less than the cloud point of the feedstock;

exposing at least a second portion of the unconverted fraction to a second hydrocracking catalyst under second effective hydroprocessing conditions to form a second hydrocracked effluent;

separating the second hydrocracked effluent to form a second gas phase portion and the second liquid phase portion; and sending at least a portion of the second liquid phase portion to the first fractionator.

Embodiment 2

The method of embodiment 1, wherein at least about 80 wt % of the feedstock boils below about 700° F. (about 371° C.).

Embodiment 3

The method of any of the above embodiments, wherein the weight of the unconverted product stream corresponds to less than about 25 wt % of the feedstock.

Embodiment 4

The method of embodiment 3, wherein the cloud point of the unconverted product stream is at least about 20° F. (about 11° C.) less than the cloud point of the feedstock.

Embodiment 5

The method of any of the above embodiments, wherein the unconverted product stream has a cetane number of at least about 50.

Embodiment 6

The method of any of the above embodiments, wherein the unconverted product stream has a T10 boiling point of at least about 425° F. (about 218° C.).

Embodiment 7

The method of any of the above embodiments, wherein the T90 boiling point of the unconverted product stream is about 700° F. (about 371° C.) or less.

Embodiment 8

The method of any of the above embodiments, wherein about 25 wt % or less of the unconverted product stream boils above about 600° F. (about 316° C.).

Embodiment 9

The method of any of the above embodiments, wherein the first effective hydroprocessing conditions are selected from effective hydrocracking conditions or effective hydrotreating conditions.

Embodiment 10

The method of any of the above embodiments, wherein during exposing of the first hydrocracked effluent to the first dewaxing catalyst, the space velocity of the first hydrocracked effluent relative to the first dewaxing catalyst is at least about 15 $hr^{-1}$.

Embodiment 11

The method of any of the above embodiments, further comprising quenching the first hydrocracked effluent prior to exposing the first hydrocracked effluent to the first dewaxing catalyst.

Embodiment 12

The method of any of the above embodiments, wherein the first dewaxing catalyst comprises ZSM-48, ZSM-23, zeolite Beta, or a combination thereof.

Embodiment 13

The method of any of the above embodiments, further comprising exposing the second hydrocracked effluent to a second dewaxing catalyst under second effective catalytic dewaxing conditions.

Embodiment 14

The method of any of the above embodiments, wherein the weight of the naphtha fraction corresponds to at least about 75 wt % of the feedstock.

Embodiment 15

The method of any of the above embodiments, wherein the feedstock comprises a light cycle oil from a fluid catalytic cracking process, and sending the naphtha fraction to a reformer unit and producing an improved naphtha product stream, wherein the improved naphtha product stream has a higher octane value (RON+MON) than the naphtha fraction.

Examples of Reaction System Configurations

FIG. 1 shows an example of a two stage reaction system 100 for producing a converted and unconverted product according to an embodiment of the invention. In FIG. 1, a first stage of a two stage hydrocracking system is represented by reactors 110 and 120. A hydrocarbon feed 112 and a hydrogen stream 114 are fed into reactor 110. Hydrocarbon feed 112 and hydrogen stream 114 are shown as being combined prior to entering reactor 110, but these streams can be introduced into reactor 110 in any other convenient manner. Reactor 110 can contain one or more beds of hydrotreating and/or hydrocracking catalyst. The feed 112 can be exposed to the hydrotreating and/or hydrocracking catalyst under effective hydrotreating and/or hydrocracking conditions. The entire effluent 122 from reactor 110 can then be cascaded into reactor 120. Optionally, an additional hydrogen stream 124 can be added to reactor 120, such as by adding additional hydrogen stream 124 to first reactor effluent 122. Reactor 120 can also include one or more beds of hydrotreating and/or hydrocracking catalyst. Additionally, reactor 120 can also include one or more beds of dewaxing catalyst 128 downstream from the hydrocracking catalyst in reactor 120. Optionally, a quench stream 127 can be included prior to dewaxing catalyst bed(s) 128, such as a hydrogen quench stream.

The hydrocracked and dewaxed effluent 132 from reactor 120 can be passed into separator 130 for separation into a gas phase portion 135 and a liquid phase portion 142. The gas phase portion 135 can be used in any convenient manner, such as by scrubbing the gas phase portion to allow for recovery and recycle of the hydrogen in gas phase portion 135. Liquid phase portion 142 can be sent to fractionator 140 for fractionation into at least a converted portion and an unconverted portion. In the embodiment shown in FIG. 1, fractionator 140 produces a light naphtha portion 146 and a heavy naphtha portion 147 as converted portions. Fractionator 140 also typically produces a bottoms or unconverted portion 152. An unconverted product stream 155 can be withdrawn from unconverted portion 152. The unconverted product stream 155 can be a diesel product generated by the reaction system. The remainder of unconverted portion 152 can be used as the input for reactor 150, which can serve as the second stage in the reaction system. An optional hydrogen stream 154 can also be introduced into reactor 150. The input into reactor 150 can be exposed to one or more beds of hydrocracking and/or hydrotreating catalyst in reactor 150. Optionally, one or more beds of dewaxing catalyst 158 can also be included in reactor 150. The one or more beds of dewaxing catalyst 158 can be in addition to and/or instead of the one or more beds of dewaxing catalyst 128 in the first stage. The effluent 162 from reactor 150 can be separated in separator 160 to form a gas phase portion 165 and a liquid phase portion 172. The gas phase portion 165 can be used in any convenient manner, such as by scrubbing the gas phase portion to allow for recovery and recycle of the hydrogen in gas phase portion 165. The liquid phase portion 172 can be fractionated in fractionator 140. The liquid phase portion 172 can be introduced into fractionator 140 in any convenient manner. For ease of display in FIG. 1, liquid phase portion 172 is shown as entering the fractionator separately from stream 142. Liquid phase portion 172 and liquid phase portion 142 can alternatively be combined prior to entering fractionator 140.

Figure 2:
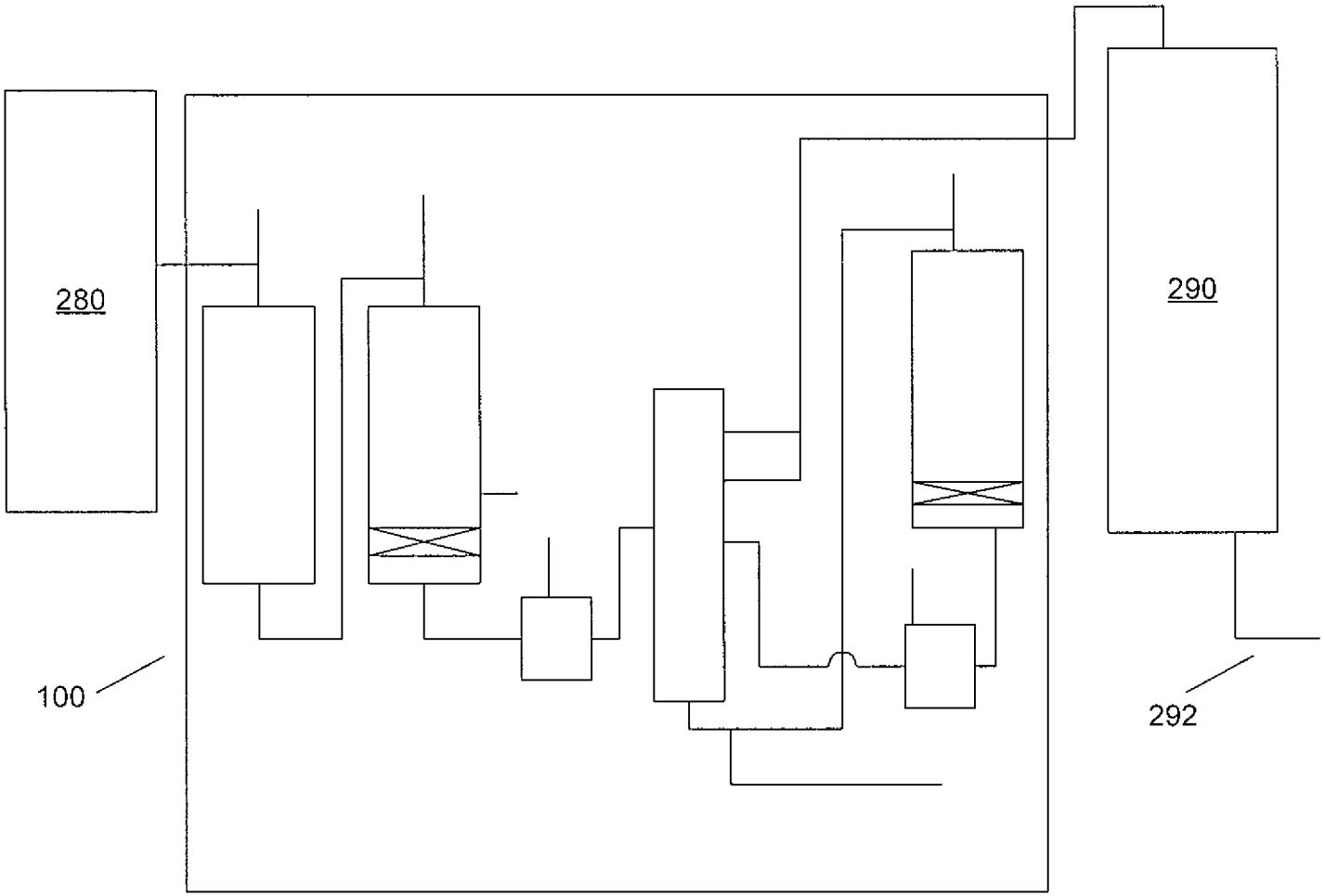
FIG. 2 schematically shows a second embodiment of a reaction system suitable for processing of a hydrocarbon feed according to the invention.

FIG. 2 shows the integration of a reaction system such as the reaction system in FIG. 1 with other refinery processes. In FIG. 2, the reaction system 100 shown in FIG. 1 is represented within the central box. In FIG. 2, the input feedstream to reaction system 100 corresponds to a distillate output from a fluid catalytic cracking (FCC) unit 280. One of the potential outputs from an FCC unit 280 can be a distillate portion that has a boiling range in the same vicinity as an atmospheric gas oil. However, a naphtha stream generated by hydrocracking of an FCC distillate output can lead to a naphtha with a relatively low octane rating. In order to achieve a higher octane rating, the naphtha output from reaction system 100 can be used as a feed to a reforming reactor 290. The reforming reactor 290 can generate a naphtha output stream 292 with an improved (i.e., higher) octane rating (RON+MON) relative to the octane rating of the naphtha stream from the reaction system 100.

Processing Examples

A series of experiments were performed to test the benefits of dewaxing on unconverted products from a fuels hydrocracker. In a first set of experiments, a small scale reaction system was used to investigate the impact of dewaxing on a hydrocracked distillate feed. The experiments were designed to replicate the conditions in a dewaxing catalyst bed at the end of a hydrocracking stage. In the experiments, the treat gas used was ~100% hydrogen. The hydrogen treat gas was fed to the pilot reactor at a rate of about 2150 scf/bbl (about 366 $Nm^3/m^3$). The pressure in the reactor was maintained at about 2150 psig (about 14.8 MPag) at the reactor outlet.

Table 1 lists feedstock properties for the materials used in the first two experiments. In the first experiment a hydrocracked feed (column A) was used as feedstock. This material was selected to be representative of the unconverted portion of a commercially hydrocracked distillate feedstock. The unconverted portion of the hydrocracked distillate feed had already been severely hydroprocessed and had very low sulfur and nitrogen contents and a cloud point of about −3.6° C. The second feedstock, Column B, was comprised of the unconverted portion of the hydrocracked distillate spiked with dimethyl disulfide (DMDS) and tributyl amine (TBA) to approximate the sulfur and nitrogen contents of a commercial hydrocracker feed.

TABLE 1

| Test Description | | A Hydroprocessed Feed | B Spiked Hydroprocessed Feed |
|---|---|---|---|
| API Gravity | | 40.4 | 39.5 |
| Cloud Point | ° C. | −3.6 | −3.6 |
| Sulfur | ppm | 3.5 | 18,600 |
| Nitrogen | | <0.2 | 580 |
| Simulated Distillation (D2887) | ° F. | | |
| 0.5% Off | | 295 | 218 |
| 5% | | 352 | 3520 |
| 10% | | 380 | 381 |
| 20% | | 417 | 418 |
| 50% | | 493 | 493 |
| 80% | | 600 | 601 |
| 90% | | 655 | 657 |
| 95% | | 689 | 693 |
| 99:5% | | 763 | 766 |
| Aromatics | wt % | | |
| 1-Ring | | 15.5% | |
| 2-Ring | | 1.3% | |
| 3-Ring | | 0.1% | |
| Total | | 17.0% | |
| Cetane Number by NMR | | 57.5 | |

The small scale reaction system consisted of two reactors. A lead reactor contained about 121 g (about 150 $cm^3$) of a standard alumina-bound NiMo hydrotreating catalyst. The use of this catalyst was necessary to decompose the DMDS (to $H_2S$) and TBA (to $NH_3$) to simulate the gaseous catalyst poisons which may be present in a commercial hydrocracker. The second reactor contained about 8.98 g (about 18.5 $cm^3$) of a dewaxing catalyst followed by about 4.1 g (about 5.9 $cm^3$) of a standard alumina-bound CoMo hydrotreating catalyst. The dewaxing catalyst used was an alumina-bound Pt/ZSM-48 containing ~0.6 wt % platinum. Versal alumina was used as the binder and the zeolite to alumina ratio was about 65:35 by weight. The silica-to-alumina ratio of the ZSM-48 was approximately 90. All catalysts were pre-sulfided prior to use. Note that the lead reactor containing NiMo catalyst was bypassed for the initial experiment using unspiked distillate feed.

Table 2 shows the results from processing of the feeds in the small scale reaction system. Columns 1 and 2 of Table 2 show results from processing of the unconverted portion of hydrocracked feed from Column A in Table 1. Column 3 of Table 2 corresponds to processing of the spiked fed from Column B in Table 1.

TABLE 2

| Feedstock Test Description | | 1 Hydro-processed Feed | 2 Hydro-processed Feed | 3 Spiked Hydro-processed Feed |
|---|---|---|---|---|
| API Gravity at ~60° F. | | 42.3 | 42.3 | 41.3 |
| Cloud Point (ISL) | ° C. | −8.0 | −12.2 | −8.3 |
| Simulated Distillation (ASTM D2887), ° F. | | | | |
| 0.5% off (T0.5) | | 280 | 268 | 208 |
| 5% (T5) | | 343 | 339 | 344 |
| 10% (T10) | | 369 | 367 | 373 |
| 20% (T20) | | 433 | 431 | 437 |
| 50% (T50) | | 485 | 484 | 487 |
| 80% (T80) | | 557 | 555 | 558 |
| 90% (T90) | | 649 | 648 | 686 |
| 95% (T95) | | 685 | 684 | 686 |
| 99:5% (T99.5) | | 755 | 756 | 761 |
| Aromatics | wt % | | | |
| 1-Ring | | 0.5% | 0.4% | 12.0% |
| 2-Ring | | 0.1% | 0.1% | 0.7% |
| 3-Ring | | — | — | 0.1% |
| Total | | 0.6% | 0.5% | 12.8% |
| $H_2$ Consumption | scf/bbl | 331 | 331 | 177 |
| Adjusted $H_2$ Consumption | scf/bbl | 331 | 331 | 107 |
| Dewaxing Temperature | ° F. | 595 | 614 | 740 |
| LSHSV | $hr^{-1}$ | 10 | 10 | 15 |

Columns 1 and 2 in Table 2 illustrate the ability of a Pt/ZSM-48 dewaxing catalyst to reduce pour point at high space velocity. Because the dewaxing occurred in a sweet environment, significant aromatics saturation and hydrogen consumption occurred. Column 3 shows that the dewaxing catalyst was also effective for reducing cloud point in a sour environment, similar to the environment of a commercial hydrocracker. The presence of ammonia and $H_2S$ result in significantly lower aromatics saturation and lower hydrogen consumption than for the unspiked feed. The dewaxing catalyst was effective for reducing cloud point for the spiked distillate feed at a throughput of about 15 LHSV. It is noted that in a commercial embodiment, the amount of dewaxing catalyst in a reactor may only be one bed within the reactor. As a result, even though the overall space velocity in a reactor may be between about 0.1 to about 5 $hr^{-1}$, the effective space velocity relative to just the dewaxing catalyst tends to be higher.

To more fully approximate the material that the dewaxing catalyst would process in a fuels hydrocracking reaction system, the unconverted portion of hydrocracked feed of Table 1 was blended with light and heavy hydrocracked naphthas (representing converted portions of feed) in a weight ratio of about 25:25:50 light naphtha/heavy naphtha/unconverted portion. This was believed to simulate a composition that could be present at the end of the first stage in a two stage fuels hydrocracking reactor. The resulting blend was spiked with DMDS and TBA to approximate the sulfur and nitrogen levels of the hydrocracker feed. Table 3 shows various properties of the light naphtha, heavy naphtha, unconverted portion of hydrocracked feed, and the combined spiked blend.

TABLE 3

| | | Light HDC Naphtha | Heavy HDC Naphtha | Hydro-cracked Feed | Spiked Blend |
|---|---|---|---|---|---|
| API Gravity at ~60° F. | — | 58.6 | 46.6 | 40.4 | 45.1 |
| Cloud Point | ° C. | — | — | −3.6 | — |
| Sulfur | ppm | 1.5 | 1.9 | 3.5 | 19,100 |
| Nitrogen | ppm | <0.2 | <0.2 | <0.2 | 648 |
| Simulated Distillation, ° F. | | | | | |
| 0.5% off (T0.5) | | 125 | 151 | 295 | 126 |
| 5% (T5) | | 131 | 220 | 352 | 157 |
| 10% (T10) | | 138 | 240 | 380 | 187 |
| 20% (T20) | | 176 | 278 | 417 | 224 |
| 50% (T50) | | 199 | 293 | 493 | 333 |
| 80% (T80) | | 225 | 320 | 600 | 521 |
| 90% (T90) | | 244 | 341 | 655 | 595 |
| 95% (T95) | | 250 | 353 | 689 | 650 |
| 99:5% (T99.5) | | 277 | 377 | 763 | 741 |

The Spiked Blend feed shown in Table 3 was processed over the dual reactor system described earlier at about 10 LHSV over the dewaxing catalyst, about 2150 psig (about 366 $Nm^3/m^3$), and a treat gas rate of about 3360 scf/bbl (about 570 $Nm^3/m^3$) of ~100% $H_2$. Liquid products were collected and distilled to roughly the same cutpoint of the hydrocracked feed. In Table 4, yield on charge refers to the weight of unconverted product recovered relative to the weight of the spiked feed. For the experiments shown in Table 4, hydrogen consumption ranged from about 220 scf/bbl (about 37 $Nm^3/m^3$) to about 250 scf/bbl (about 43 $Nm^3/m^3$) and 350° F.+ (171° C.+) conversion ranged from about 0.5% to about 2.0%, indicating the relatively high selectivity of the Pt/ZSM-48 for distillate cloud reduction, without secondary cracking to light gases. A summary of product properties is shown by Table 4.

TABLE 4

| Dewaxing Rxr Temp., ° F. | | 720 | 720 | 730 | 730 | 740 | 740 | 725 | 715 | 715 | 715 |
|---|---|---|---|---|---|---|---|---|---|---|---|
| Yield on charge | wt % | 47.1 | 51.3 | 51.4 | 50.9 | 51.4 | 50.6 | 47.7 | 46.6 | 45.0 | 45.7 |
| API Gravity at ~60° F. | | 41.3 | 41.5 | 41.5 | 41.5 | 41.5 | 41.4 | 41.3 | 41.3 | 41.4 | 42.5 |
| Simulated Distillation, ° F. | | | | | | | | | | | |
| 0.5% off (T0.5) | | 336 | 327 | 286 | 290 | 288 | 289 | 291 | 287 | 312 | 302 |
| 5% (T5) | | 384 | 360 | 341 | 342 | 339 | 340 | 350 | 344 | 371 | 358 |
| 10% (T10) | | 406 | 380 | 370 | 371 | 369 | 369 | 382 | 381 | 401 | 392 |
| 30% (T30) | | 459 | 443 | 439 | 439 | 437 | 438 | 450 | 454 | 458 | 456 |
| 50% (T50) | | 508 | 494 | 490 | 490 | 489 | 490 | 500 | 505 | 509 | 506 |
| 70% (T70) | | 575 | 562 | 558 | 558 | 555 | 556 | 567 | 572 | 574 | 572 |
| 90% (T90) | | 656 | 649 | 647 | 647 | 645 | 645 | 651 | 654 | 655 | 654 |
| 95% (T95) | | 690 | 684 | 682 | 682 | 680 | 680 | 685 | 688 | 688 | 687 |
| 99.5% (T99.5) | | 762 | 754 | 752 | 753 | 751 | 752 | 754 | 756 | 756 | 755 |
| Cloud Point (Automated) | ° C. | −9.6 | −11.2 | −13.8 | −14.0 | −17.2 | −17.2 | −11.5 | −10.0 | −10.8 | −11.0 |
| Cloud Point (Manual) | ° C. | −11 | −12 | −16 | −15 | −18 | −19 | −12 | −10 | −11 | −12 |
| Cetane Number by NMR | | 58.8 | 57.0 | — | — | — | — | — | — | — | — |

Table 4 shows that a dewaxing catalyst can effectively improve the cloud point of unconverted product in a mixed naphtha/unconverted product stream that could be present in a commercial hydrocracker. Comparing the data in Table 4 with the results shown in Table 2 also demonstrates an unexpected result. Based on the data in Table 4, it appears that exposing the dewaxing catalyst to unconverted product mixed with naphtha streams (converted products) resulted in an increase in the activity of the dewaxing catalyst. This can be seen more clearly by comparing the data in Table 2 with the data shown in FIG. 3.

Figure 3:
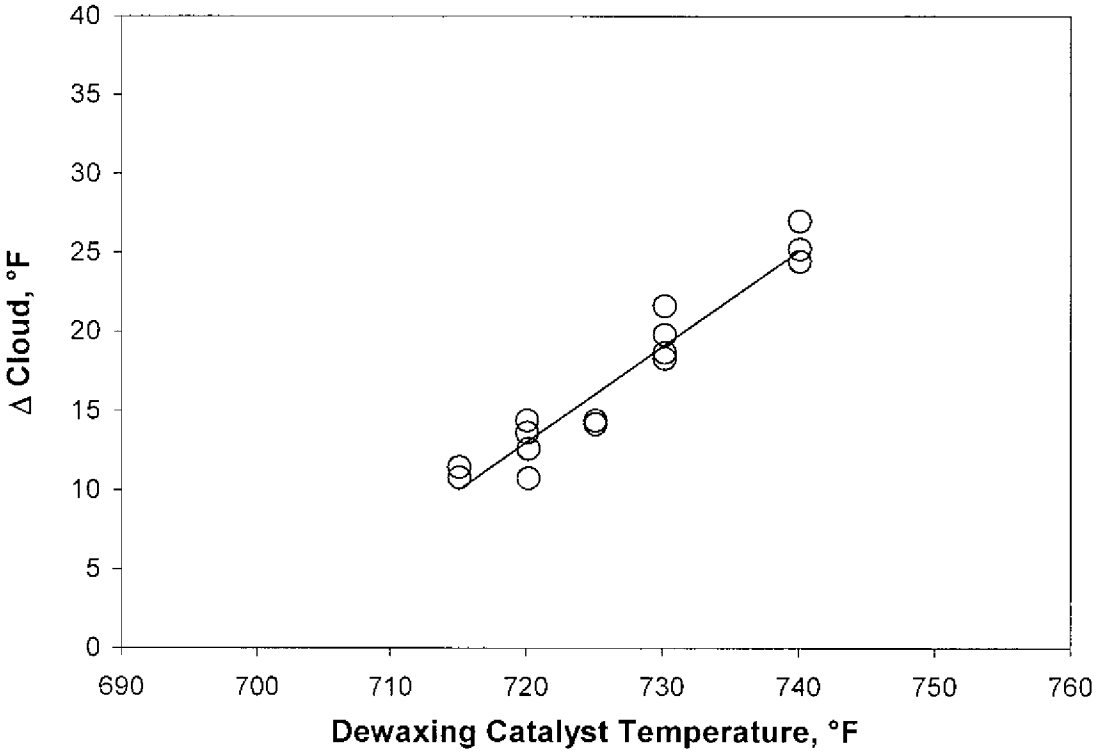
FIG. 3 shows a plot of the amount of cloud point reduction as a function of dewaxing temperatures for the series of experiments shown in Table 4.

FIG. 3 shows a plot of the amount of cloud point reduction as a function of temperature for a series of experiments at the dewaxing temperatures and conditions shown in Table 4. The data in FIG. 3 can be compared with the results shown in Table 2. For example, for the data shown in Table 2 for a spiked feed at 15 LHSV, a reaction temperature greater than about 740° F. was required to reach a ~5° C. cloud point reduction. However, with the naphtha present, FIG. 3 suggests that less than about 710° F. would be required to reach a ~5° C. cloud point with the diluted feed. It is noted that the feed for the data in FIG. 3 contained roughly 50% naphtha, which would be expected to have little or no interaction with the catalyst. As a result, the LHSV of about 10 $hr^{-1}$ over the dewaxing catalyst for the total feed would correspond to an LHSV of about 20 $hr^{-1}$ for just the unconverted portion of the feed. Thus, the LHSV for just the unconverted portion was actually 33% higher than the LHSV of about 15 $hr^{-1}$ for the undiluted example shown in Table 2. The magnitude of the beneficial impact of naphtha was unexpected and, without being bound by theory, may reflect reduced diffusional resistance owing to lower viscosity of the hydrocarbon liquid. This unexpected benefit means that higher flow rates of feed can be used within a hydrocracking stage while still achieving a desired cloud point reduction. Alternately, the amount of dewaxing catalyst required within a stage can be reduced, due to the beneficial impact of the naphtha during dewaxing.

Although the present invention has been described in terms of specific embodiments, it is not so limited. Suitable alterations/modifications for operation under specific conditions should be apparent to those skilled in the art. It is therefore intended that the following claims be interpreted as covering all such alterations/modifications as fall within the true spirit/scope of the invention.

What is claimed is:

1. A method for producing a naphtha product and an unconverted product, comprising:

exposing a feedstock comprising an atmospheric gas oil, a virgin distillate or a hydrotreated virgin distillate having a boiling range in which at least 90 wt % boils above 350° F. to a first hydrocracking catalyst under first effective hydrocracking conditions to form a first hydrocracked effluent, the feedstock having a cetane number of about 35 or less, at least about 60 wt % of the feedstock boiling above about 400° F. (about 204° C.) and at least about 60 wt % of the feedstock boiling below about 650° F. (about 343° C.);

exposing the first hydrocracked effluent, without intermediate separation, to a first dewaxing catalyst comprising Pt-ZSM-48 under first effective dewaxing conditions to form a first dewaxed effluent;

separating the dewaxed effluent to form a first gas phase portion and a first liquid phase portion;

fractionating the first liquid phase portion and a second liquid phase portion in a first fractionator to form at least one naphtha fraction and an unconverted fraction, the naphtha fraction corresponding to at least about 65 wt % of the feedstock and having a final boiling point of about 400° F. (about 204° C.) or less;

withdrawing at least a first portion of the unconverted fraction as an unconverted product stream, the weight of the unconverted product stream corresponding to from about 5 wt % to about 35 wt % of the feedstock; wherein the unconverted product stream has an initial boiling point of at least about 400° F. (about 204° C.), a cetane number of at least about 45, and a cloud point at least about 10° F. (about 6° C.) less than the cloud point of the feedstock;

exposing at least a second portion of the unconverted fraction to a second hydrocracking catalyst under second effective hydrocracking conditions less severe than the first hydrocracking conditions to form a second hydrocracked effluent;

exposing the second hydrocracked effluent, without intermediate separation, to a second dewaxing catalyst under second effective dewaxing conditions to form a second dewaxed effluent;

separating the second dewaxed effluent to form a second gas phase portion and the second liquid phase portion; and sending at least a portion of the second liquid phase portion to the first fractionator.

2. The method of claim 1, wherein at least about 80 wt % of the feedstock boils below about 700° F. (about 371° C.).

3. The method of claim 1, wherein the weight of the unconverted product stream corresponds to from about 5 wt % to about 25 wt % of the feedstock.

4. The method of claim 3, wherein the cloud point of the unconverted product stream is at least about 20° F. (about 11° C.) less than the cloud point of the feedstock.

5. The method of claim 1, wherein the unconverted product stream has a cetane number of at least about 50.

6. The method of claim 1, wherein the unconverted product stream has a T10 boning point of at least about 425° F. (about 218° C.).

7. The method of claim 1, wherein the T90 boiling point of the unconverted product stream is about 700° F. (about 371° C.) or less.

8. The method of claim 1, wherein about 25 wt % or less of the unconverted product stream boils above about 600° F. (about 316° C.).

9. The method of claim 1, wherein during exposing of the first hydrocracked effluent to the first dewaxing catalyst, the space velocity of the first hydrocracked effluent relative to the first dewaxing catalyst is at least about 15 $hr^{-1}$.

10. The method of claim 1, further comprising quenching the first hydrocracked effluent prior to exposing the first hydrocracked effluent to the first dewaxing catalyst.

11. The method of claim 1, wherein the weight of the naphtha fraction corresponds to at least about 75 wt % of the feedstock.

* * * * *